US008584758B2

(12) United States Patent
Radmanovich et al.

(10) Patent No.: US 8,584,758 B2
(45) Date of Patent: Nov. 19, 2013

(54) APPARATUS FOR FRACTURING OF WELLS

(75) Inventors: Donald J. Radmanovich, Tofield (CA); Daniel Seutter, Calgary (CA)

(73) Assignee: 1473706 Alberta Ltd., Calgary, Alberta (CA)

( * ) Notice: Subject to any disclaimer, the term of this patent is extended or adjusted under 35 U.S.C. 154(b) by 319 days.

(21) Appl. No.: 12/784,743

(22) Filed: May 21, 2010

(65) Prior Publication Data

US 2011/0284229 A1 Nov. 24, 2011

(51) Int. Cl.
*E21B 43/26* (2006.01)

(52) U.S. Cl.
USPC ..... 166/308.1; 166/285; 166/387

(58) Field of Classification Search
USPC ..... 166/187, 285, 290, 308.1, 387
See application file for complete search history.

(56) References Cited

U.S. PATENT DOCUMENTS

| | | | | |
|---|---|---|---|---|
| 2,798,560 | A * | 7/1957 | Allen et al. | 277/333 |
| 4,499,947 | A * | 2/1985 | Zsoka et al. | 166/179 |
| 4,606,406 | A | 8/1986 | Wood | |
| 4,655,286 | A * | 4/1987 | Wood | 166/285 |
| 4,714,117 | A | 12/1987 | Dech | |
| 4,869,324 | A | 9/1989 | Holder | |
| 5,174,375 | A | 12/1992 | Mims et al. | |
| 5,526,878 | A | 6/1996 | Duell et al. | |
| 5,615,741 | A | 4/1997 | Coronado | |
| 5,711,372 | A | 1/1998 | Stokley | |
| 5,738,171 | A | 4/1998 | Szarka | |
| 5,791,416 | A | 8/1998 | White et al. | |
| 6,209,663 | B1 | 4/2001 | Hosie | |
| 6,302,214 | B1 | 10/2001 | Carmichael et al. | |
| 6,578,638 | B2 | 6/2003 | Guillory et al. | |
| 7,284,619 | B2 | 10/2007 | Stokley et al. | |
| 7,306,033 | B2 | 12/2007 | Gorrara | |
| 7,543,634 | B2 | 6/2009 | Fehr et al. | |
| 2009/0078422 | A1 | 3/2009 | Manson | |

FOREIGN PATENT DOCUMENTS

WO 0129367 A1 4/2001

OTHER PUBLICATIONS

Jeroen Nijhof et al., "Zonal-Isolation Barriers Meet Valhall Waterflooding, Fracturing Demands," JPT, Dec. 2009, pp. 22-25.
"Source Energy Unveils MultiStim Retriev_A_Seat," www.sourceenergy.ca, The Roughneck, Sep. 2009, pp. 22-27.
StackFRAC® HD, Packers Plus High Density Multi-Stage Fracturing System, www.packersplus.com (originally cited May 21, 2010, re-citing for legibility).

* cited by examiner

*Primary Examiner* — Giovanna Wright
*Assistant Examiner* — Richard Alker
(74) *Attorney, Agent, or Firm* — Abel Law Group, LLP

(57) ABSTRACT

A process for fracturing a lined well uses a packer assembly in a liner string that provides a cement-free segment and interface with the formation. The device has multiple packers with inflatable elements that are run as an integral assembly. After the liner assembly is positioned, cement is circulated into the assembly and wiped from the interior of the liner string into the annulus. Pressure within the liner string is elevated to initiate time delays for the radial inflation of the packer elements. The inflation radially and axially displaces the cement surrounding the elements before the cement sets. Each packer is subsequently opened to expose the frac ports in the packer directly to the formation for frac operations.

10 Claims, 15 Drawing Sheets

APPARATUS FOR FRACTURING OF WELLS

BACKGROUND OF THE INVENTION

1. Field of the Disclosure

The present invention relates in general to stimulating oil and gas wells and, in particular, to a system, method and apparatus for a fracturing process for wells having a liner, such as a cemented-in liner.

2. Description of the Related Art

Compared to vertical oil and gas wells, conventional horizontal well bore profiles focus on well bore sections that increase the surface area of the producing formation. Many of these producing formations do not readily release their contents until some form of well stimulation is conducted. Stimulation methods often use fluids to fracture the formation to provide additional exposed surface area. Such hydraulic operations have proven beneficial to increase production rates by fracturing the producing formation with fluids that contain proppants such as sand granules. Once in position, proppants maintain an open fracture in the formation that results from the fracturing process. Open fractures aid in allowing the petroleum products to exit the formation and be produced at the surface.

Initially, oil and gas wells were completed by perforating a string of production casing in selected locations. A stimulation process would then be conducted with all perforations exposed to the same fracturing operation. This method does not control the fracturing operation to ensure that each area of perforations receives the same amount of proppant.

An alternative completion method uses independent placement of perforations above a frac or bridge plug, followed by a fracturing operation of that set of perforations. Subsequently, another plug would then be set up hole to separate the perforations, and the operation would be repeated. This type of completion requires numerous trips in and out of the well with various assemblies. It also creates a significant amount of standby time for the surface equipment on location.

More recently, selective hydraulic fracturing of horizontal well bores has been accomplished with combinations of open hole packers and sliding sleeves that are installed at various intervals in the casing string. Each sliding sleeve is located between a pair of packers that control and force the fracture fluid into the formation.

This design, however, has its limitations as they require open holes in order to operate. As a result, these open hole packers have an inherent differential pressure limitation as they attempt to isolate adjacent formation sections. Due to the relatively short contact length that the packer element has with the formation, leak paths can occur during frac initiation. Once this leak path occurs the selective or independent frac feature is compromised. In addition, this open hole frac assembly is incompatible with a cement-in liner application. The material or cement in the annulus surrounding the frac ports blocks communication with the formation. Various methods have been attempted to penetrate, erode or dissolve the cement that blocks the frac access or limits the frac penetration of the surrounding formation. The complexity of these methods raises the cost of completion and increases the required time to complete the well. Thus, improvements in the design and implementation of stimulating wells would be desirable.

SUMMARY

Embodiments of a system, method and apparatus for a fracturing process for wells having a liner are disclosed. In some embodiments, the device and process readily allow for fracturing of well bore formations that have a cemented-in liner. Fluid or cement is used to locate and seal a liner string in position while the device provides a cement-free segment and interface with the formation. Multiple units can be used to increase the number of independent interfaces with the formation. The units are run as an integral assembly in the liner and spaced at intervals that are determined by the well designer. The liner assembly includes packers that are in position prior to the circulation of the cement slurry.

After the liner assembly is correctly positioned, cement is circulated into the assembly. After cement is injected into the drill string, a liner wiper plug is used to chase the cement down hole while wiping the inside surfaces of the liner string. When the wiper plug engages the landing seat, it latches in position allowing the internal pressure to rise within the liner string. The elevated pressure then initiates a time delay for the radial inflation of the packer elements with a fluid such as water.

For example, the packer elements inflate in a sequence beginning at the deepest location, and both radially and axially displace the cement surrounding the elements before the cement sets. In some embodiments, each subsequent packer at a shallower depth has a longer time delay allowing the displaced cement to travel up hole in the annulus between the bore and the liner string. This sequence continues until all of the packer elements are inflated. The liner hanger/packer assembly is subsequently set to anchor and seal the liner assembly in the bore.

Embodiments of an activation sequence for the assembly begin after the cement sets and hardens. A sleeve activation device, such as a hydraulic shifting tool, is run into position on conventional or coiled tubing. The shifting tool is used to individually locate and slide a port sleeve in each packer to the open position by engaging the unique internal profile of the sleeve. In some operations, the sleeve in the bottom packer may be activated first to prevent fracturing of the formation segments that are more shallow. As the sleeve is axially moved to the open position, it deflates and moves the element to open the frac ports. The sleeve can be directly coupled to the element through the ports to ensure adequate movement of the element.

In some embodiments, a sealing mechanism such as a cup tool or hydraulic tubing packer is located below the shifting tool. This prevents the frac fluid from traveling past the shifting tool assembly. The shifting tool assembly may be moved a specified distance below the open sleeve prior to beginning the frac operation. This allows a greater flow area for the frac fluid to pass through and out into the specific formation zone. When the desired frac volume has been circulated the shifting tool assembly is moved, typically upward, to open the next sleeve. The frac process is repeated until all zones are stimulated.

The foregoing and other objects and advantages of these embodiments will be apparent to those of ordinary skill in the art in view of the following detailed description, taken in conjunction with the appended claims and the accompanying drawings.

BRIEF DESCRIPTION OF THE DRAWINGS

So that the manner in which the features and advantages of the embodiments are attained and can be understood in more detail, a more particular description may be had by reference to the embodiments thereof that are illustrated in the appended drawings. However, the drawings illustrate only some embodiments and therefore are not to be considered limiting in scope as there may be other equally effective embodiments.

The use of the same reference symbols in different drawings indicates similar or identical items.

DETAILED DESCRIPTION

Figure 1:
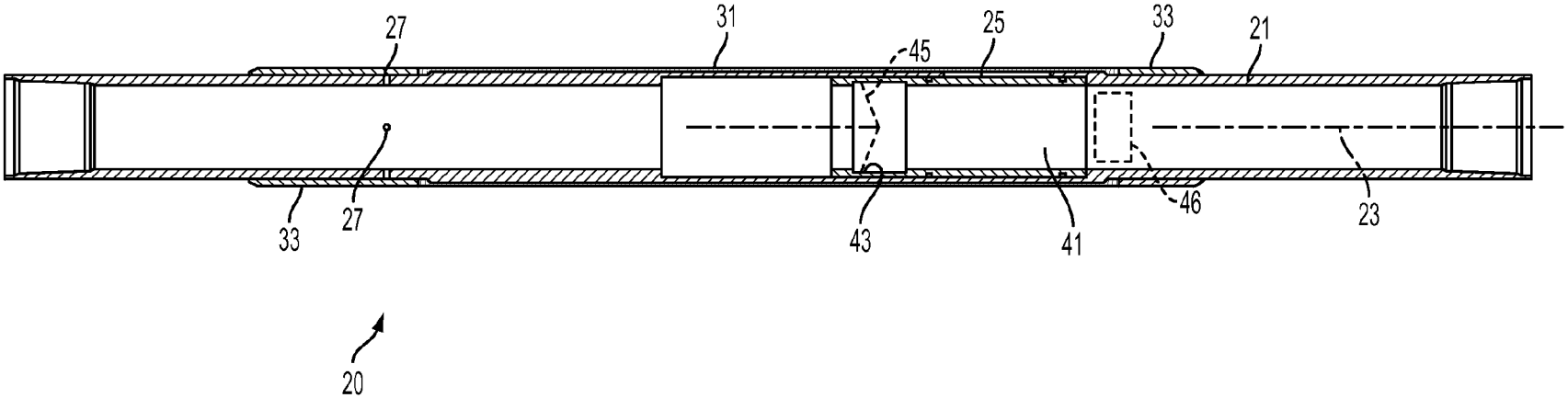
FIG. 1 is a sectional side view of one embodiment of a packer assembly shown in a nominal position.
Figure 2:
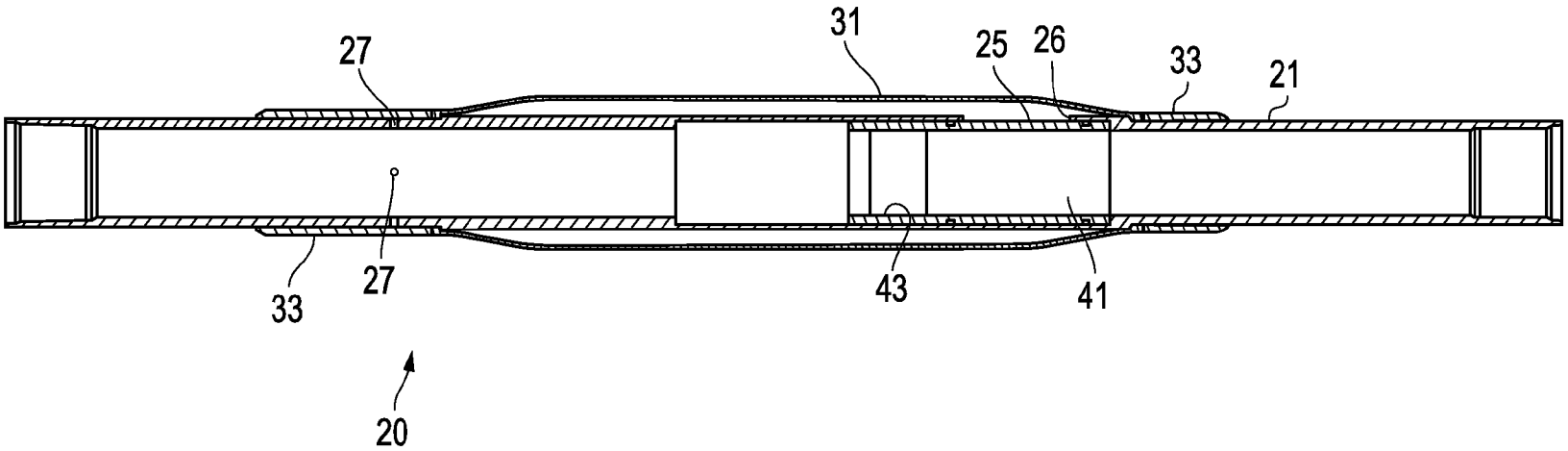
FIG. 2 is a sectional side view of the packer assembly of FIG. 1 shown in an inflated position.

Embodiments of a system, method and apparatus for a fracturing process for wells having a liner are disclosed. In some embodiments, the device and process utilize a packer assembly 20 such as that depicted in FIGS. 1-3. The packer assembly 20 may comprise a tubular member 21 having an axis 23, at least one aperture 25 or frac port formed therein and extending radially to an exterior thereof, and an inflation valve assembly 27.

In some embodiments, an inflatable element 31 is mounted to the exterior of the tubular member 21. The inflatable element 31 covers the aperture 25 and is in fluid communication with the inflation valve assembly 27. The inflatable element may comprise a housing 33 that mounts to the exterior of the tubular member 21, and an inflatable bladder 31 mounted to and extending from the housing 33. The bladder 31 may be elastic and formed from an elastomer.

Figure 12:
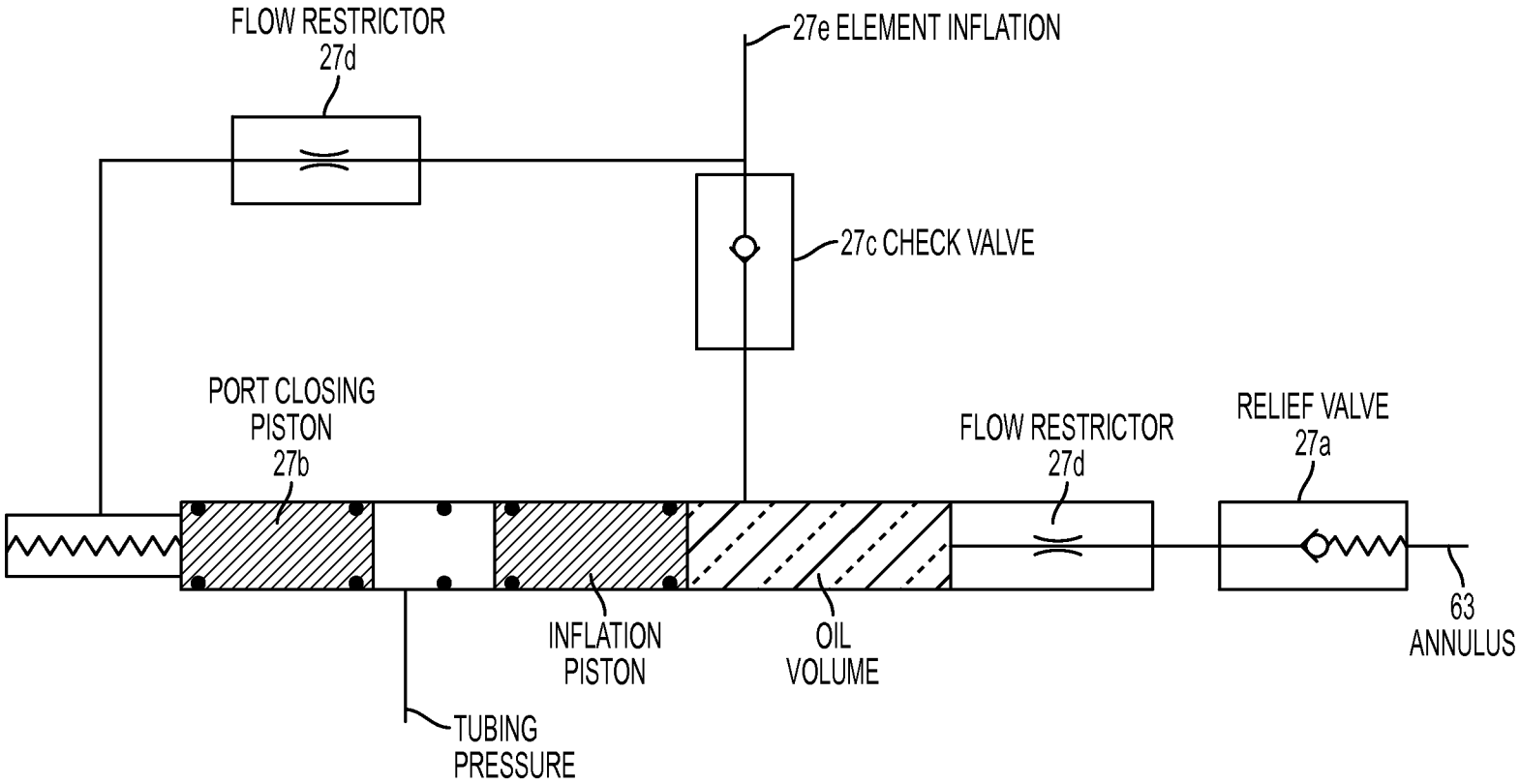
FIG. 12 is a schematic diagram of one embodiment of inflation system for a packer assembly.

The inflation valve assembly 27 may comprise a minimum pressure threshold to prevent premature inflation of the bladder 31, and a maximum pressure threshold to prevent over inflation of the bladder 31. The inflation valve assembly 27 may be electronically or hydraulically controlled. As shown in FIG. 12, some embodiments may comprise a pressure relief valve 27*a* to prevent premature inflation of the inflatable element, a port closing piston 27*b* to prevent over inflation of the inflatable element and to prevent ingress of fluid after inflation is completed, and a check valve 27*c* to prevent element deflation after inflation is completed.

A sleeve 41 may be located in an interior of the tubular member 21 axially adjacent the aperture 25. The sleeve 41 has a profile 43 that is adapted to be engaged by a tool 45 for manipulating the sleeve 41. The sleeve 41 is axially movable from a closed position (FIGS. 1 and 2) that seals the aperture 25, to an open position (FIG. 3) that unseals and permits radial access to the aperture 25.

Figure 3:
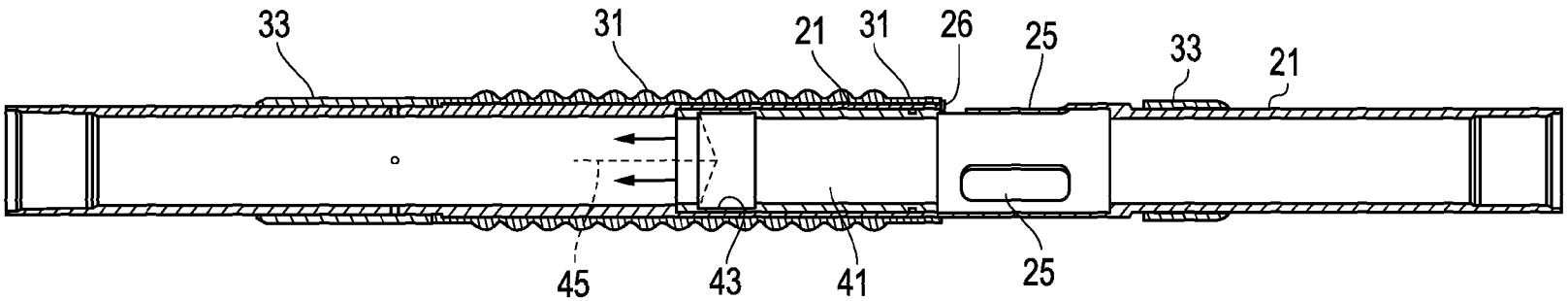
FIG. 3 is a sectional side view of the packer assembly of FIG. 1 shown in an deflated position.
Figure 13:
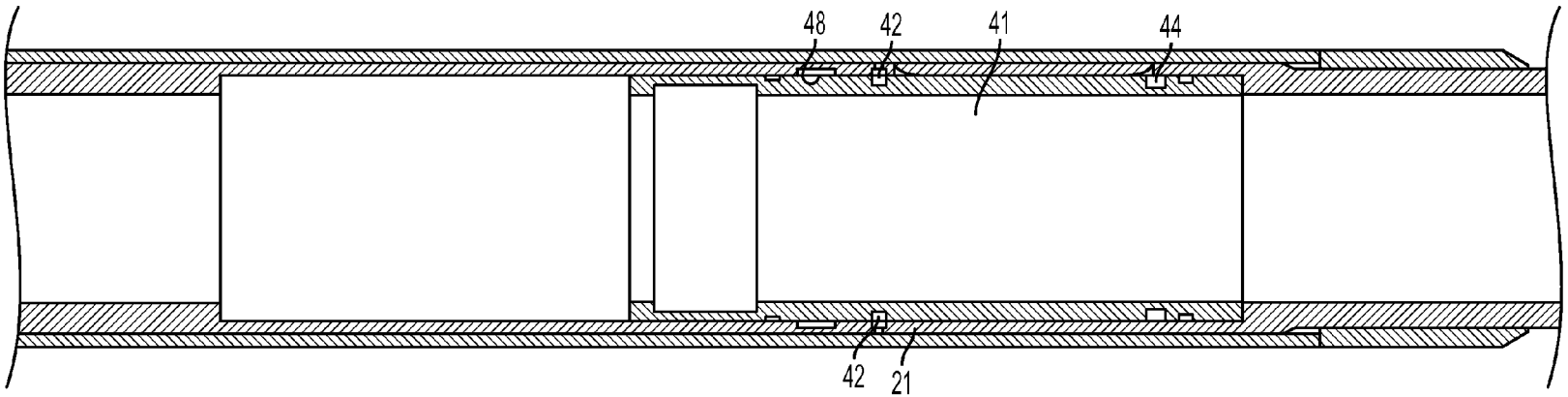
FIGS. 13 and 14 are sectional side views of an alternate embodiment of a system having shear and detent features.
Figure 14:
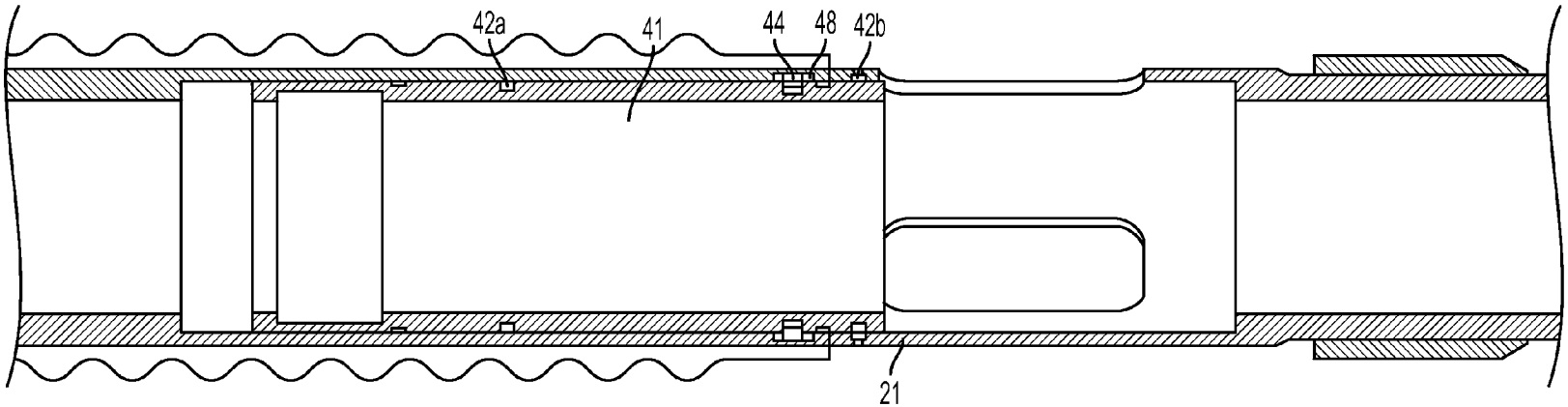

As shown in FIG. 3, moving the sleeve 41 to the open position also axially moves and collapses the bladder 31. The sleeve 41 may be directly coupled to the bladder 31 via a coupling 26 though the aperture 25 to ensure adequate movement and displacement of the bladder 31 for fracturing. In addition, the sleeve 41 may have a shear element 42 (FIG. 13), such as one or more shear screws, to prevent premature activation of the sleeve. In FIG. 13, shear element 42 secures sleeve 41 to tubular member 21 to prevent incidental axial movement therebetween. In FIG. 14, sleeve 41 was moved axially right to left, shearing the shear element into portion 42*a* in sleeve 41 and portion 42*b* in tubular member 21.

The sleeve 41 may be movable or returnable from the open position back to the closed position. Alternatively, a locking device 44 (e.g., a C-ring) may be mounted in a recess in the sleeve 41 (FIG. 13) prior to actuation, and then spring into and lock in a detent 48 (FIG. 14) in the tubular member 21 to permanently lock the sleeve 41 in the open position when it is moved from the closed position.

Figure 4:
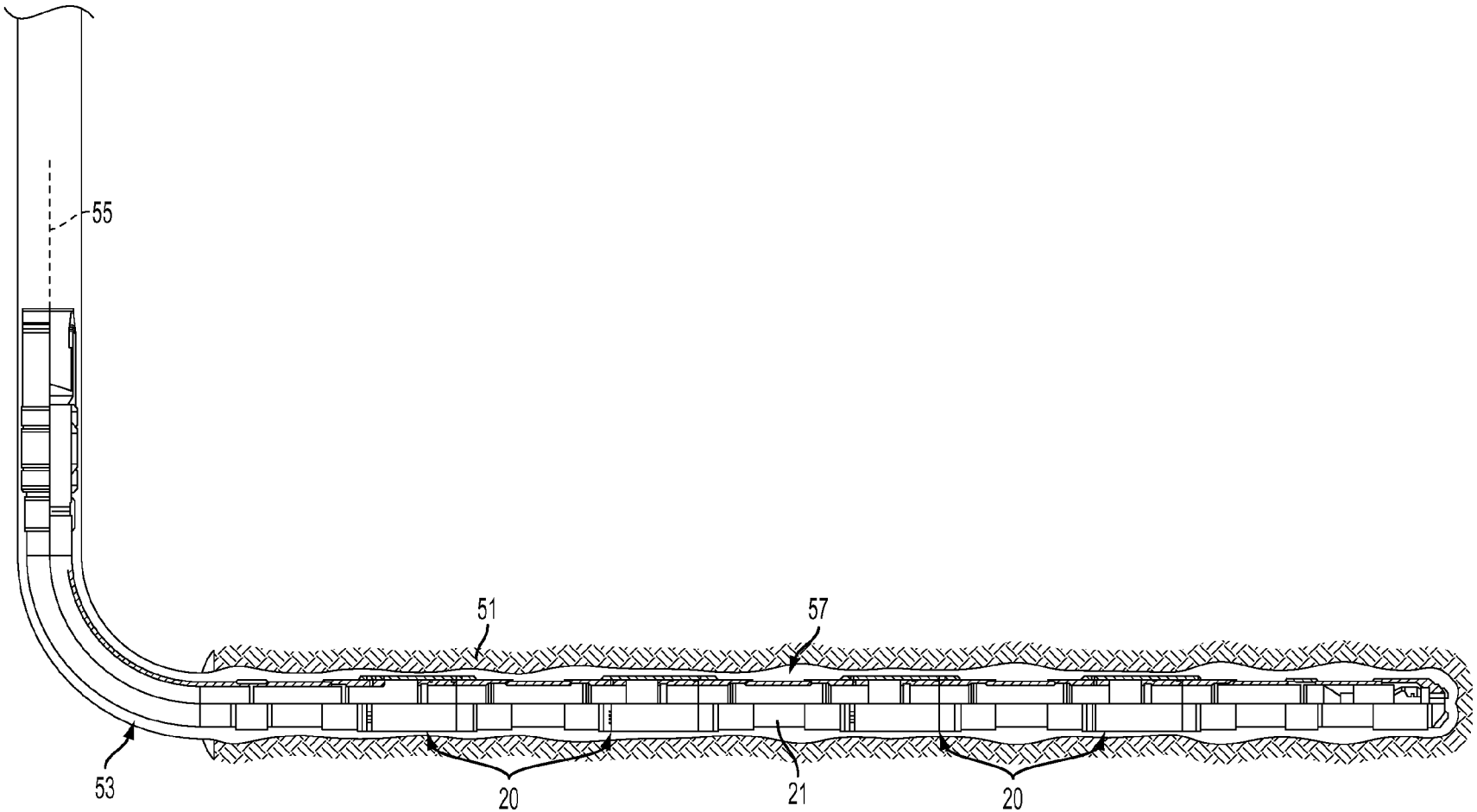
FIG. 4 is a partially-sectioned side view of an embodiment of a system for utilizing packer assemblies, shown in an initial position.

Referring to FIGS. 4-12, embodiments also may comprise a system and method for fracturing a well 51 having a cemented-in liner. As shown in FIG. 4, the system may comprise forming a liner string 53 having an axis 55 and a liner assembly 57 with the tubular member 21. A plurality of packer assemblies 20 may be integrally mounted in the tubular member 21 and the liner string 53 is run into the bore of the well 51. Each of the packer assemblies 20 and tubular member 21 may comprise the components, elements and features as described elsewhere herein. Although only four packer assemblies 20 are shown for ease of illustration, more or fewer may be used depending on the application.

In some embodiments (FIG. 1) the packer assemblies 20 may be integrally formed with the tubular member 21. In other embodiments (FIG. 7), each packer assembly 20 has its own tubular member 22, that is mounted in (e.g., threaded into) other tubular members 21 to form the liner assembly 57.

Figure 5:
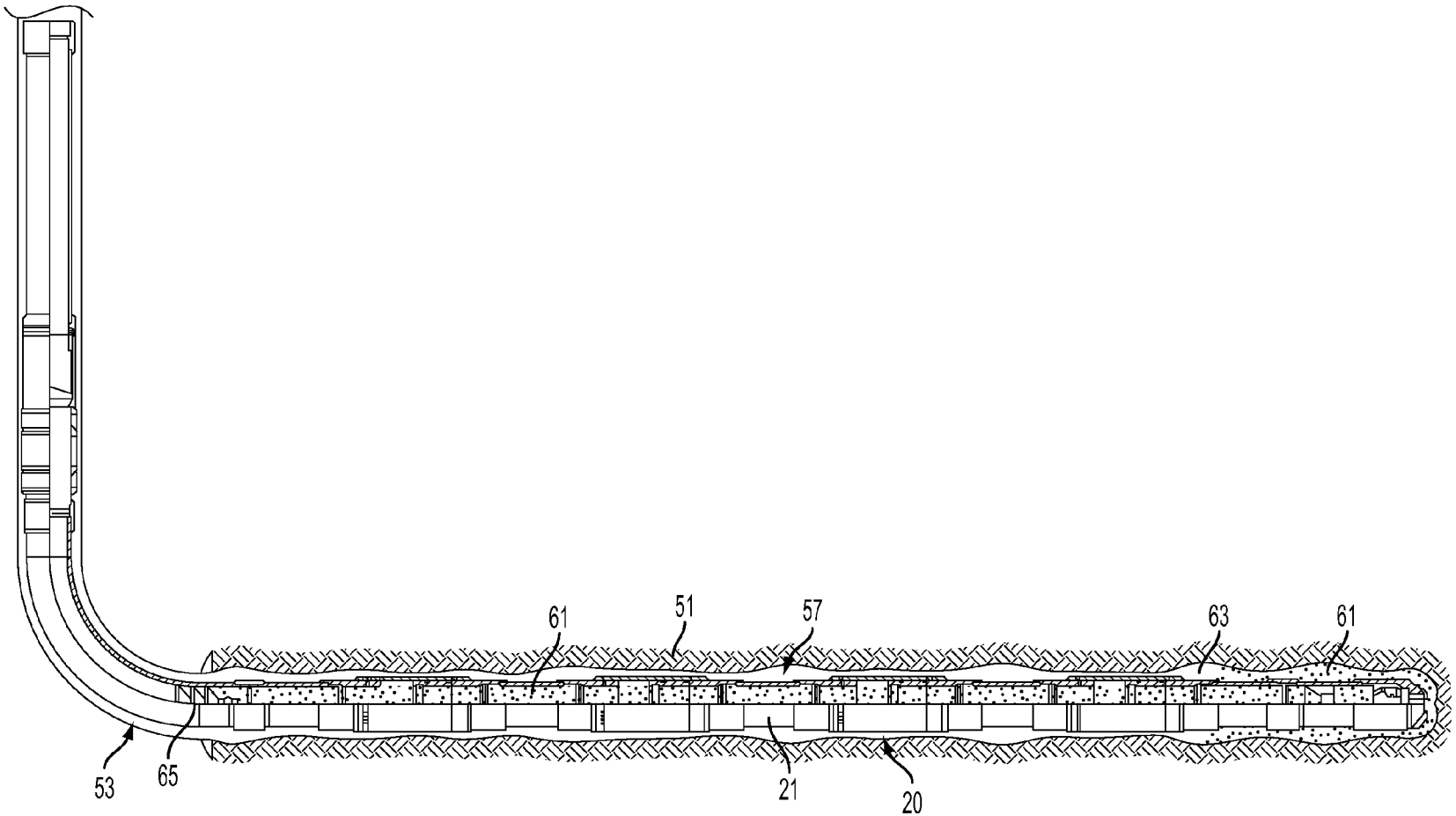
FIG. 5 a partially-sectioned side view of the system of FIG. 4 shown in a cement circulation position.
Figure 7:
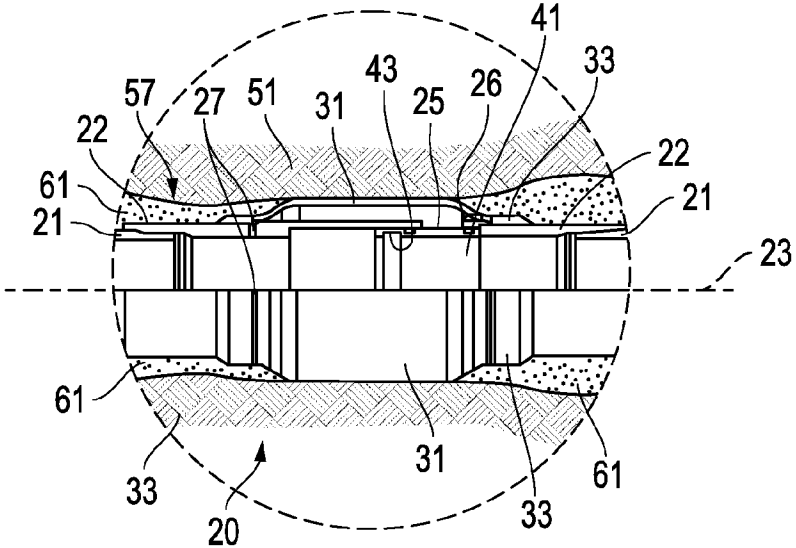
FIG. 7 an enlarged, partially-sectioned side view of an embodiment of a packer assembly for the system of FIG. 4 shown in an inflated position.
Figure 6:
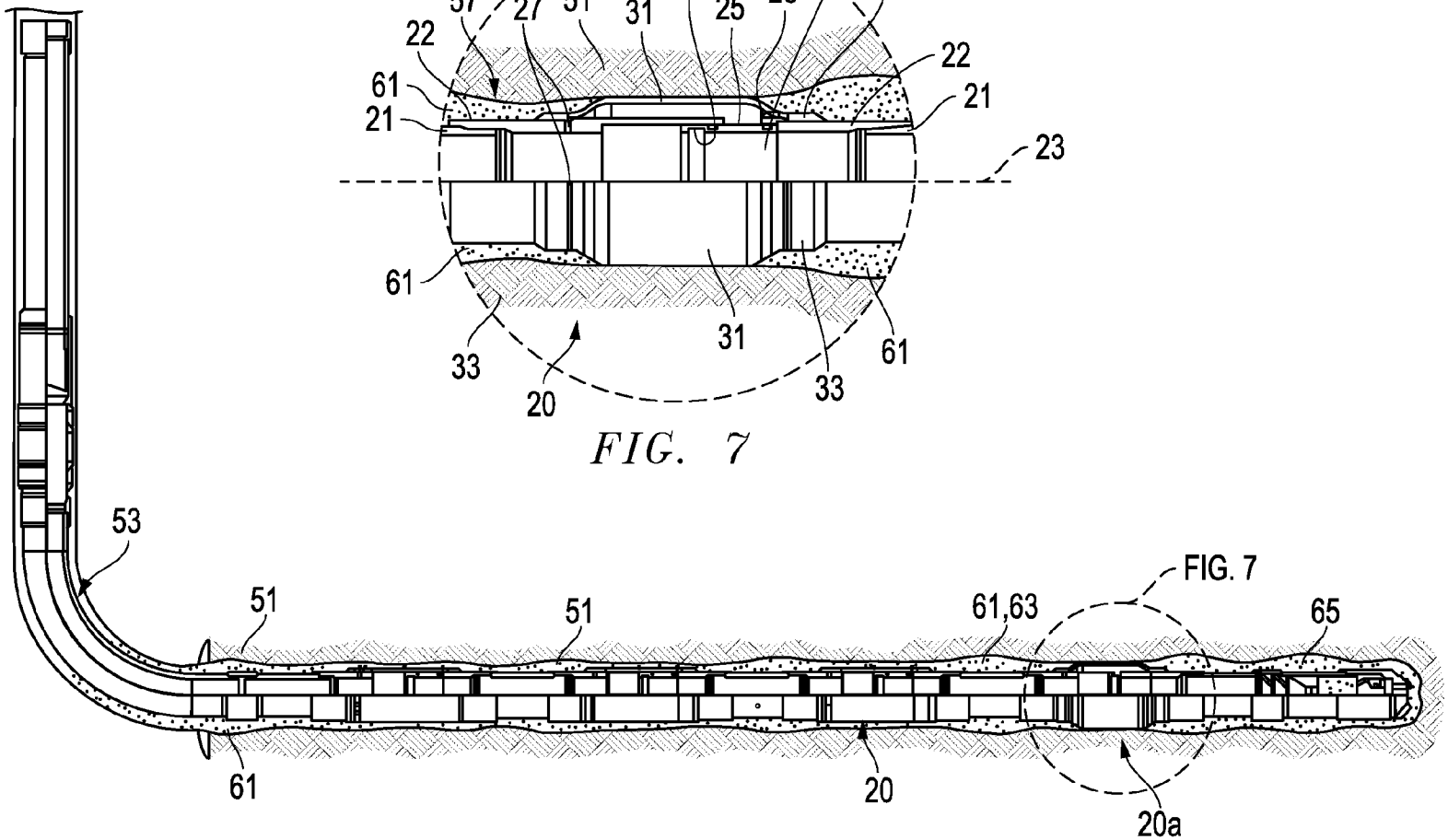
FIG. 6 a partially-sectioned side view of the system of FIG. 4 shown with the cement displaced into the annulus and one packer inflated.
Figure 8:
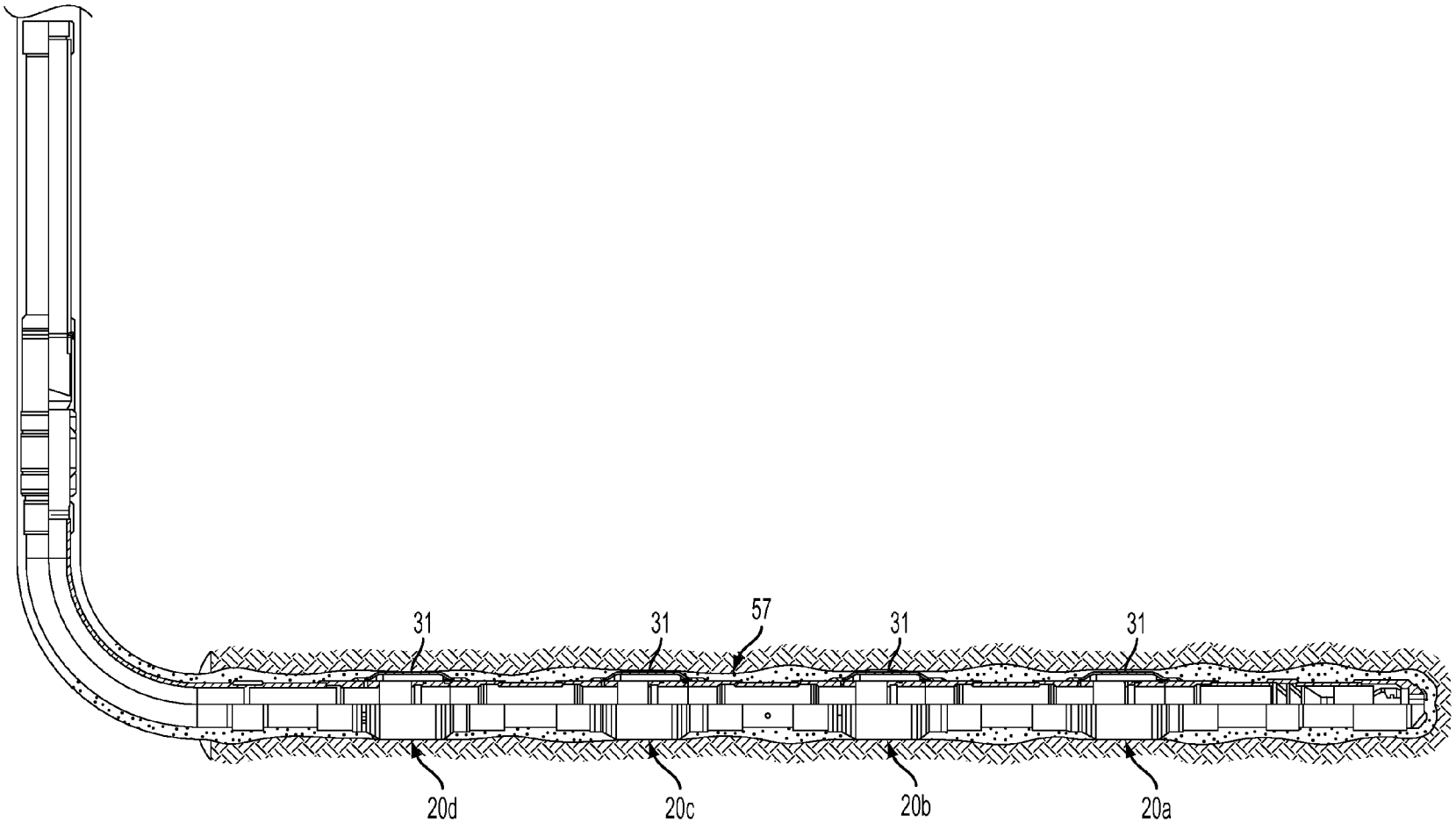
FIG. 8 a partially-sectioned side view of the system of FIG. 4 shown with all of the packer assemblies inflated.
Figure 10:
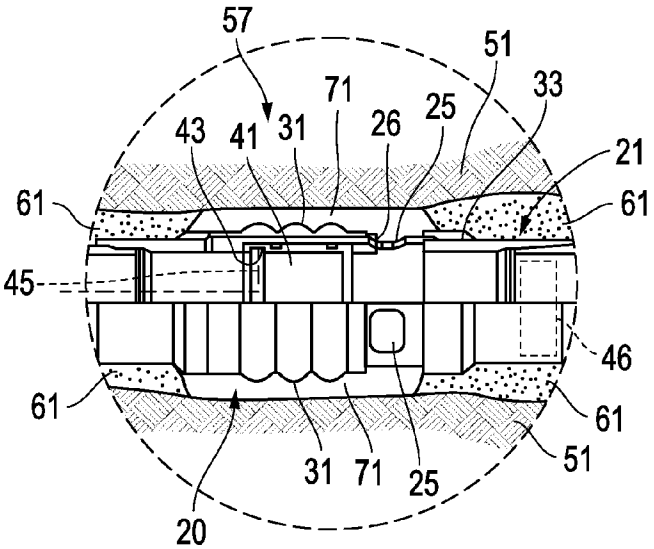
FIG. 10 an enlarged, partially-sectioned side view of an embodiment of a packer assembly for the system of FIG. 4 shown deflated.
Figure 9:
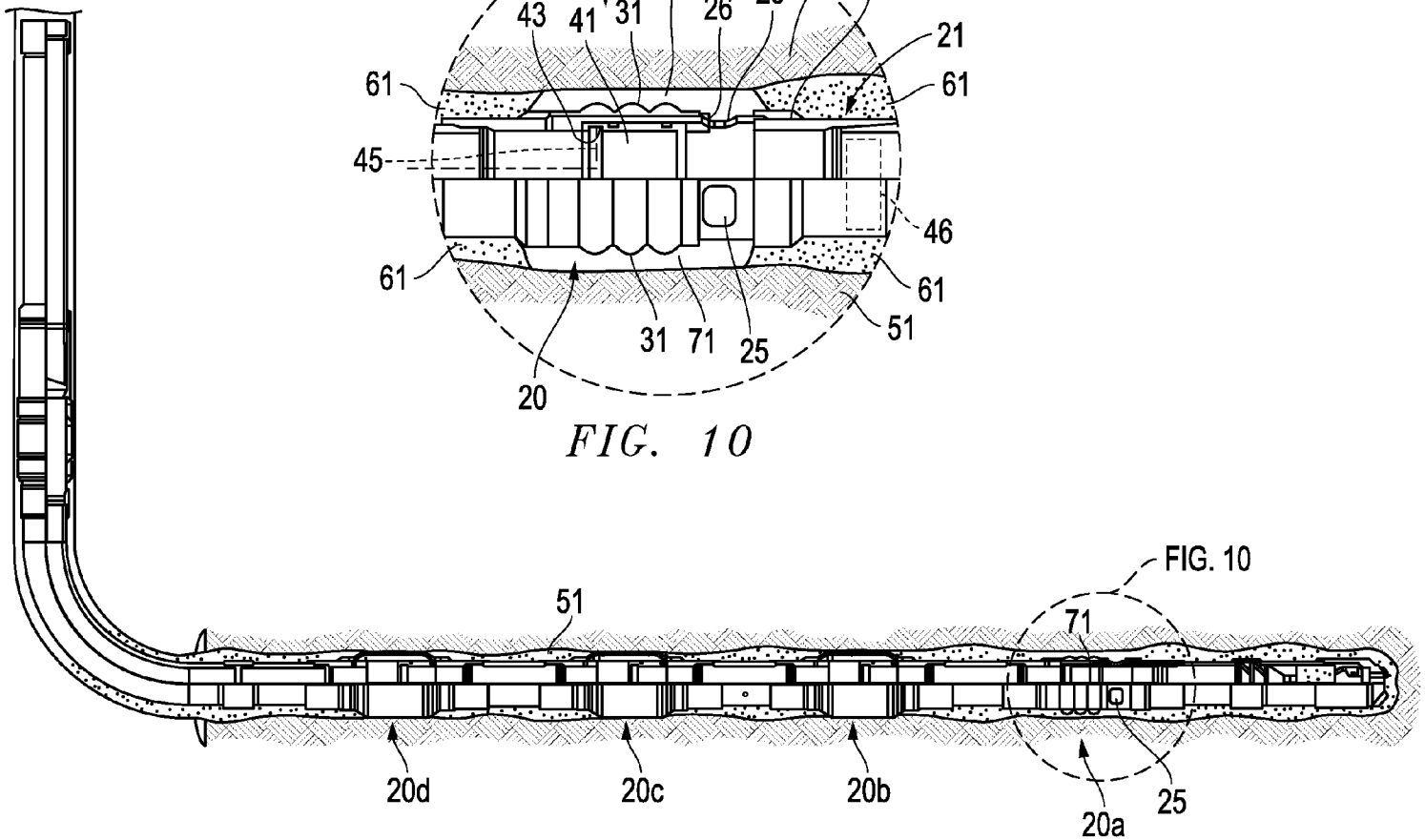
FIG. 9 a partially-sectioned side view of the system of FIG. 4 shown with one packer deflated.
Figure 11:
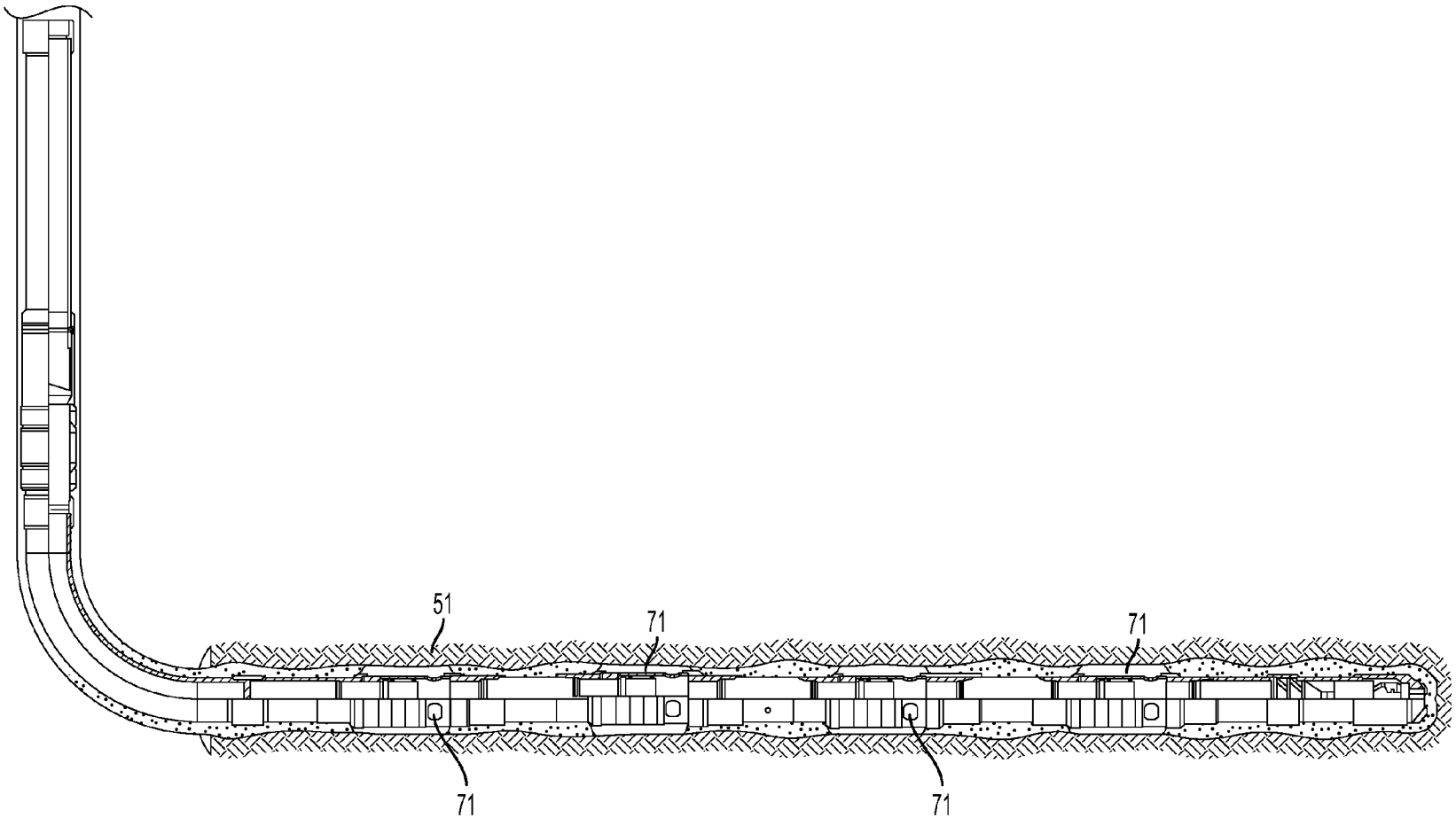
FIG. 11 a partially-sectioned side view of the system of FIG. 4 shown with all of the packers deflated.

As shown in FIG. 5, a fluid 61, such as a high viscous fluid, epoxy or cement, is circulated down through the liner assembly 57 and into an annulus 63 between the liner assembly 57 and the bore of the well 51. The cement 61 is chased out of the liner assembly 57 with a wiper plug 65, and discharged into the annulus 63. The wiper plug 65 is landed at a bottom (FIG. 6) of the liner assembly 57 to increase pressure in the liner string 53 and liner assembly 57 to initiate setting of the packers 20.

Again referring to FIG. 6, the bladder 31 is inflated on at least one of the packers 20*a*, such that cement 61 located between its bladder 31 and the well 51 is radially and axially displaced. As will be further described herein, this will ultimately form an independent, cement-free segment and interface 71 (FIG. 9) through apertures or frac ports 25 with a formation of the well 51. In some embodiments (FIG. 8), the bladders 31 are individually inflated to form respective independent, cement-free segments and interfaces 71 with the formation of the well 51.

The bladders 31 of the packers 20*a-d* may be sequentially inflated from a bottom of the liner assembly 57 to a top thereof, such that the cement is axially displaced from the bottom and pushed to the top. For example, the bladders may be inflated on time delays, such as various types of flow restrictors 27*d* (FIG. 12), that increase from the bottom to the top. The time delays may be electronically or hydraulically actuated. The cement 61 is allowed to set. In some embodiments, the bladders 31 have inflation ports 27*e* (FIG. 12) that are closed after inflation so that subsequent frac fluid, materials and pressures cannot enter the bladder.

After the cement has set, sleeve 41 in at least one of the packers 20*a* is actuated (FIGS. 9 and 10) to collapse and deflate the bladder 31 and open at least one aperture or frac port 25 in the packer 20. More than one or all of the packers 20 (FIG. 11) may be actuated with a tool 45 (e.g., FIG. 10, hydraulic shifting tool) that is run into position on tubing. The formation is subsequently fractured through each of the opened packers 20. The hydraulic shifting tool 45 may individually locate and slide the sleeve 41 in each packer 20 to the open position by engaging the internal profile 43 of the sleeve 41. Fracturing of the formation occurs through the frac ports 25. Fracturing may occur through each packer 20 before a subsequent packer 20 is actuated. In addition, a sealing mechanism 46 (FIG. 10) such as a movable plug may be located below the hydraulic shifting tool 45 to prevent frac fluid from traveling past the hydraulic shifting tool 45.

Figure 15:
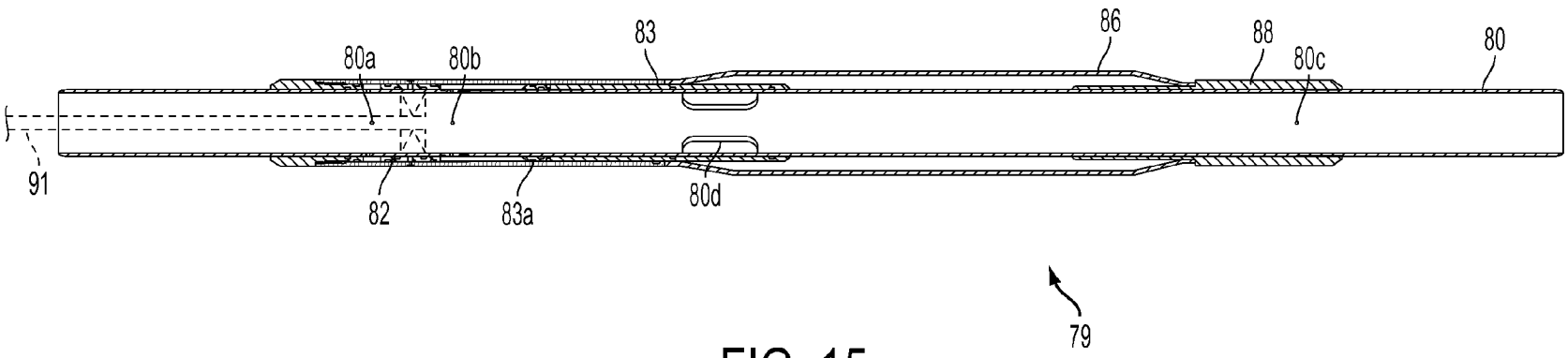
FIGS. 15-17 are sectional side views of another embodiment of a packer assembly.
Figure 16:
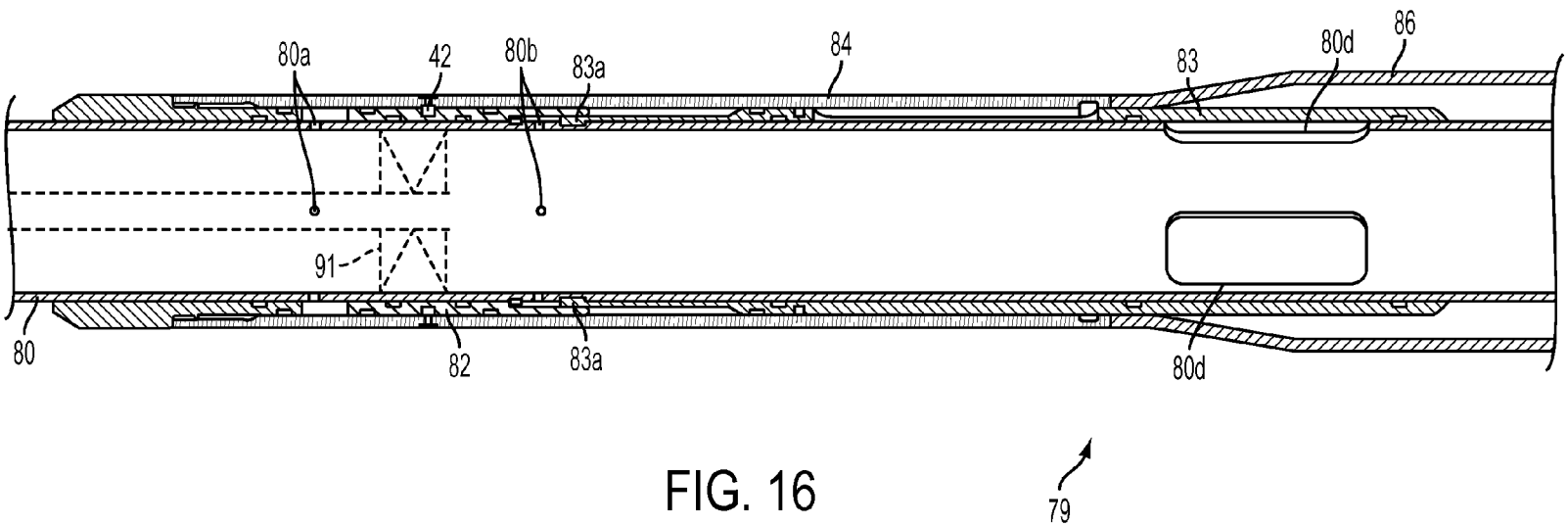
Figure 17:
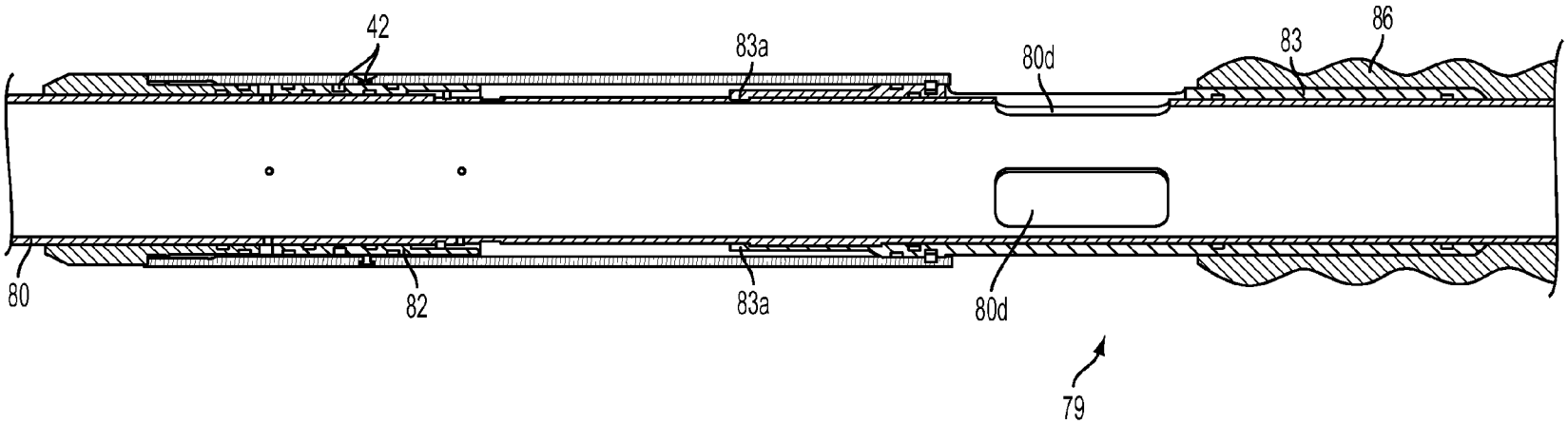

Referring now to FIGS. 15-17, a packer assembly 79 has an inflatable element or bladder 86 and valve mechanism 88 that are similar to the previously described designs. At a predetermined pressure and after the time delay has transpired, the fluid in the tubing 80 inflates the bladder 86 through port 80*c* to the desired pressure. This inflation displaces the cement in the annulus area surrounding the packer.

Once the cement is cured or hardened, a release tool 91 is inserted in the liner string on the end of conventional or coiled tubing. When the release tool 91 is set in position, a pressure differential is achievable between ports 80*a* and 80*b*. When the pressure in port 80*b* is increased to a predetermined level above the pressure in port 80*a*, a retaining piston 82 shears loose (see, e.g., shear element 42) and allows the collet fingers 83*a* on a sleeve 83 to release. Embodiments of sleeve 83 are located external of tubing 80 between the outer surface of tubing 80 and housing 84 for the bladder 86, such that the bore of tubing 80 is unobstructed.

As pressure is continued to be applied in port 80*b*, the retaining piston 82 moves (e.g., right to left in FIG. 17) to release the pressure in bladder 86 by hydraulically forcing sleeve 83 to move (e.g., left to right in FIG. 17) and open the frac port windows 80*d*. Thus, the release tool 91 is positioned between and provides a barrier between ports 80*a, b* in the tubular member 80 for hydraulically actuating both the retaining piston 82 and the sleeve 83. Sleeve 83 is released mechanically by the retaining piston 82 but is moved hydraulically rather than directly with the shifting tool 91. Shifting tool 91 is moved and set at a deeper depth in the liner string. The frac process is then conducted through the open frac port 80*d* as described herein, and the process is repeated as needed.

In still other embodiments, a method of fracturing a well having a liner comprises forming a liner string with a plurality of packer assemblies mounted in a liner assembly having an axis and a tubular member; running the liner string in a well; circulating fluid through the liner string to the liner assembly; discharging the fluid through the liner assembly into an annulus between the liner assembly and the well; increasing pressure in the liner assembly to initiate setting of the packers; inflating a bladder on at least one of the packers, such that fluid located between the bladder and the well is radially and axially displaced to form an independent, fluid-free segment and interface with a formation of the well; allowing the fluid to set; actuating said at least one of the packers to deflate the bladder and open a frac port in said at least one of the packers; and directly fracturing the formation unimpeded through the frac port, such that the fracturing operation is unobstructed by fluid or cement between the frac port and the formation.

The discharging step may comprise chasing the fluid out of the liner assembly with a wiper plug, and landing the wiper plug at a bottom of the liner assembly to increase pressure in the liner string. The method may further comprise individually inflating bladders in other ones of the packers and forming respective independent, fluid-free segments and interfaces with the formation. The method also may further comprise sequentially inflating other ones of the bladders from a bottom of the liner assembly to a top thereof and axially displacing the fluid from the bottom to the top.

Embodiments of the method may further comprise inflating one or more of the bladders on a time delay, and the time delay for inflation of the bladders may increase from the bottom to the top. The time delay may be electronically or hydraulically actuated, and further comprise actuating more than one or all of the packers with a hydraulic shifting tool that is run into position on tubing, fracturing the formation through each of the packers, and fracturing occurs through selected ones or each packer before a subsequent packer is actuated. The hydraulic shifting tool may individually locate and slide a sleeve in each packer to an open position by engaging an internal profile of the sleeve, and further comprise locating a sealing mechanism below the hydraulic shifting tool to prevent frac fluid from traveling past the hydraulic shifting tool; and closing an inflation port of the bladder after inflation so that subsequent frac fluid, materials and pressures cannot enter the bladder, and shearing open a sleeve in the packer to prevent premature activation.

In still other embodiments, each packer has a sleeve located between an exterior of the tubular member and a bladder housing, and the method hydraulically actuates a retaining piston to release the sleeve, and hydraulically forcing the sleeve to move the bladder. The method may further comprise sealing off ports in the tubular member by positioning a release tool between the ports for hydraulically actuating both the retaining piston and the sleeve.

Embodiments of the invention have numerous features and advantages. The tool allows for fluid or cement to be circulated past the OD of the tool prior to activation. The cement that surrounds the packers is displaced allowing for direct stimulation of the formation once the frac ports are opened. Premature initiation of the inflation process is prevented using devices such as a pressure relief valve or pressure burst disc. These features enable fluid(s) circulation prior to the cementing process, which assists in getting the liner assembly into the desired position.

In addition, the time delay system for individual inflation of the elements allows for numerous packer assemblies to be run in the same string. The delay also permits the displacement of cement back toward the surface as, for example, the elements are sequentially inflated from bottom to top. The inflation sequence may begin with the deepest packer element. Furthermore, the time delay system can be controlled electronically or with hydraulic fluid control components. Once an element is inflated the fluid volume is locked into the inflated element and is prevented from prematurely venting back into the liner ID. The element typically remains inflated until the cement has set.

After inflation is completed, the valve mechanism closes the inflation port so that subsequent frac fluid, materials and pressures cannot enter the element. The internal sliding sleeve may have a shear device incorporated to prevent premature activation. The internal sleeve movement determines when an element is deflated. The internal sleeve is coupled to the element to ensure that the element is properly dislocated from the frac ports in the packer body. Accordingly, this ensures direct access of frac fluid to the formation. When the sleeve is opened it may be permanently locked into the open position by a C-ring or detent ring. In some variations, however, the sleeve can be closed at a later time should the formation segment begin to produce undesirable fluids such as salt water.

This written description uses examples to disclose the embodiments, including the best mode, and also to enable those of ordinary skill in the art to make and use the invention. The patentable scope is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

Note that not all of the activities described above in the general description or the examples are required, that a portion of a specific activity may not be required, and that one or more further activities may be performed in addition to those described. Still further, the order in which activities are listed are not necessarily the order in which they are performed.

In the foregoing specification, the concepts have been described with reference to specific embodiments. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of invention.

As used herein, the terms "comprises," "comprising," "includes," "including," "has," "having" or any other variation thereof, are intended to cover a non-exclusive inclusion. For example, a process, method, article, or apparatus that comprises a list of features is not necessarily limited only to those features but may include other features not expressly listed or inherent to such process, method, article, or apparatus. Further, unless expressly stated to the contrary, "or" refers to an inclusive-or and not to an exclusive-or. For example, a condition A or B is satisfied by any one of the following: A is true (or present) and B is false (or not present), A is false (or not present) and B is true (or present), and both A and B are true (or present).

Also, the use of "a" or "an" are employed to describe elements and components described herein. This is done merely for convenience and to give a general sense of the scope of the invention. This description should be read to include one or at least one and the singular also includes the plural unless it is obvious that it is meant otherwise.

Benefits, other advantages, and solutions to problems have been described above with regard to specific embodiments. However, the benefits, advantages, solutions to problems, and any feature(s) that may cause any benefit, advantage, or solution to occur or become more pronounced are not to be construed as a critical, required, or essential feature of any or all the claims.

After reading the specification, skilled artisans will appreciate that certain features are, for clarity, described herein in the context of separate embodiments, may also be provided in combination in a single embodiment. Conversely, various features that are, for brevity, described in the context of a single embodiment, may also be provided separately or in any subcombination. Further, references to values stated in ranges include each and every value within that range.

What is claimed is:

1. A system for fracturing a well having a cemented-in liner, comprising:

a liner assembly having an axis and a tubular member;

a plurality of packer assemblies mounted in the tubular member, each of the packer assemblies comprising:

an aperture formed in the tubular member and extending radially to an exterior thereof, and an inflation valve assembly;

a housing mounted to the exterior of the liner assembly, the housing having an inflatable bladder configured to cover the aperture that is in fluid communication with the inflation valve assembly; and a sleeve located in an interior of the tubular member axially adjacent the aperture, the sleeve having a closed position that seals the aperture, an open position configured to unseal and permit radial access to the aperture such that the aperture is exposed directly to a formation for unimpeded frac operations, and the sleeve is coupled to the bladder through the aperture to axially collapse the bladder when the sleeve is moved to the open position.

2. A system according to claim 1, wherein the inflation valve assembly comprises a minimum pressure threshold to prevent premature inflation of the bladder, and a maximum pressure threshold to prevent over inflation of the bladder.

3. A system according to claim 1, wherein the inflation valve assembly is electronically controlled or hydraulically controlled and comprises a pressure relief valve to prevent premature inflation of the bladder, a port closing piston to prevent over inflation of the bladder and to prevent ingress of fluid after inflation is completed, and a check valve to prevent element deflation after inflation is complete.

4. A system according to claim 1, wherein the sleeve has a shear element to prevent premature activation of the sleeve, and the sleeve has a profile for engagement by a tool to manipulate the sleeve.

5. A system according to claim 1, further comprising a locking device in the tubular member for permanently locking the sleeve in the open position, cement is circulated through the liner assembly and into an annulus between the liner assembly and the well, the cement is chased out of the liner assembly with a wiper plug, and the wiper plug is landed at a bottom of the liner assembly to increase pressure therein.

6. A system according to claim 1, wherein the bladders are individually inflated to form respective independent, cement-free segments and interfaces with the well, an inflation port of the bladder is closed after inflation so that subsequent frac fluid, materials and pressures cannot enter the bladder, and the sleeve is sheared open in the packer to prevent premature activation.

7. A system according to claim 6, wherein the bladders are sequentially inflated from a bottom of the liner assembly to a top thereof to axially displace cement from the bottom to the top.

8. A system according to claim 6, wherein the bladders are inflated on a time delay, and the time delays for inflation of the bladders increases from the bottom to the top, or the time delay is electronically or hydraulically actuated.

9. A system according to claim 1, wherein all of the packers are actuated with a hydraulic shifting tool that is run into position on tubing, the well is fractured through each of the packers before a subsequent packer is actuated.

10. A system according to claim 9, wherein the hydraulic shifting tool individually locates and slides a sleeve in each packer to an open position by engaging an internal profile of the sleeve, and a sealing mechanism is movably located below the hydraulic shifting tool to prevent frac fluid from traveling past the hydraulic shifting tool.

* * * * *